US007721374B1

(12) United States Patent
Hammack et al.

(10) Patent No.: US 7,721,374 B1
(45) Date of Patent: May 25, 2010

(54) DEBRIS/LOAD LEVELING SYSTEM

(75) Inventors: Justin R. Hammack, Huntsville, AL (US); Edward B. Stell, Newmarket, AL (US)

(73) Assignee: Schwarze Industries, Inc., Huntsville, AL (US)

( * ) Notice: Subject to any disclaimer, the term of this patent is extended or adjusted under 35 U.S.C. 154(b) by 1262 days.

(21) Appl. No.: 11/199,990

(22) Filed: Aug. 10, 2005

Related U.S. Application Data

(60) Provisional application No. 60/602,668, filed on Aug. 19, 2004.

(51) Int. Cl.
*E01H 1/05* (2006.01)

(52) U.S. Cl. ..... 15/84; 15/85

(58) Field of Classification Search ..... 15/83, 15/84, 85, 86
See application file for complete search history.

(56) References Cited

U.S. PATENT DOCUMENTS

| | | | | | |
|---|---|---|---|---|---|
| 435,144 | A | * | 8/1890 | La Batt | 15/84 |
| 742,657 | A | * | 10/1903 | Hosfeld | 15/84 |
| 996,230 | A | * | 6/1911 | Estlin | 15/84 |
| 1,097,911 | A | * | 5/1914 | Brugger | 15/340.3 |
| 1,443,190 | A | * | 1/1923 | Martin | 15/84 |
| 2,244,848 | A | * | 6/1941 | Olds et al. | 15/83 |
| 3,369,685 | A | * | 2/1968 | Price et al. | 414/501 |
| 3,649,982 | A | * | 3/1972 | Mortensen | 15/84 |
| 3,805,310 | A | * | 4/1974 | Oberdank | 15/83 |
| 4,457,044 | A | * | 7/1984 | Erdman et al. | 15/348 |
| 4,459,719 | A | * | 7/1984 | Notestine | 15/349 |
| 4,516,285 | A | * | 5/1985 | Pineau | 15/84 |
| 6,192,542 | B1 | * | 2/2001 | Frederick et al. | 15/84 |

FOREIGN PATENT DOCUMENTS

| | | | |
|---|---|---|---|
| GB | 2 240 354 | * | 7/1991 |

* cited by examiner

*Primary Examiner*—Randall Chin
(74) *Attorney, Agent, or Firm*—Wallace G. Walter

(57) ABSTRACT

A mechanized broom-type sweeper truck that includes a pavement engaging brush or broom and an elevator for transported debris to the inlet or entry opening of a debris container includes a slinging roller in the debris container mounted at or subjacent the inlet opening. The slinging roller is journalled in bearings and driven by a motor at a selected rotary speed. Surface features are provided on the roller to engage with and contact any debris coming into contact with the roller to fling, sling, throw debris away from the inlet opening.

6 Claims, 7 Drawing Sheets

DEBRIS/LOAD LEVELING SYSTEM

CROSS-REFERENCE TO RELATED PATENT APPLICATION

This application claims the benefit of U.S. Provisional Patent Application No. 60/602,668 filed Aug. 19, 2004 by the inventors herein and in common ownership herewith.

BACKGROUND OF THE INVENTION

The present invention relates to mechanized sweeper trucks that utilize a primary broom to sweep debris from roadways and, more particularly, to method and apparatus for "leveling" the debris load within the debris container of such vehicles.

Mechanical broom sweepers are designed to pick-up debris not normally accepted by conventional regenerative or vacuum-type sweepers; this debris typically including asphalt nodules of varying size consequent to asphalt milling operations, rocks, stones, construction debris, broken masonry, and the like. In a typical design, as shown in schematic fashion in FIG. 1, a primary or main broom is rotated against the road surface to brush debris in the forward direction onto a mechanical elevator. The elevator typically includes a set of parallel flights that push the debris along an inclined floor pan to carry the debris upwardly for deposit through an entry opening of a debris collection bin or hopper. Because the density of the collected debris is relatively high, the debris drops from its point of entry and collects directly beneath its point of entry. As the debris pile accumulates and increases in elevation, the collected debris at the top of the pile tends to clog or block the entry opening, even though other parts of the collection hopper are comparatively unfilled.

In general, the problem cannot be solved by merely increasing or stepping up the operating speed of the elevator to more energetically throw the debris into the debris collection hopper. The sweeping vehicle and its main broom are best operated in speed ranges that assure the efficient sweeping of debris from the roadway and the efficient projecting of that swept debris into or onto the moving elevator. Thus, for any broom speed, the elevator speed is best maintained in a speed range that prevents a situation in which the elevator flights 'overrun' the brush function.

Vehicle operators have addressed this problem by abruptly applying the vehicle brakes to cause the debris pile to slump forwardly against the front wall of the debris container away from the entry opening on the rear wall of the debris collection hopper. This solution, while temporarily effective, tends to cause premature wear of the vehicle brakes and tires.

SUMMARY OF THE INVENTION

A broom-type mechanized sweeper of the type having a broom and a mechanized elevator for transferring debris to the entry opening of a debris hopper is provided with a slinger element that slings, flings, throws, or projects debris coming into contact with the slinger element therefrom. In a preferred form, the slinger element is formed as a cylindrical roller mounted for rotation about an axis and rotated by a motor. Surface features associated with the roller, such as paddles, arms, blades, a weld-bead formation(s), grooves, or a combination thereof, function to contact and engage debris falling into contact with the roller to impart sufficient kinetic energy thereto that the debris is thrown away from the roller.

DESCRIPTION OF THE PREFERRED EMBODIMENT

Figure 2:
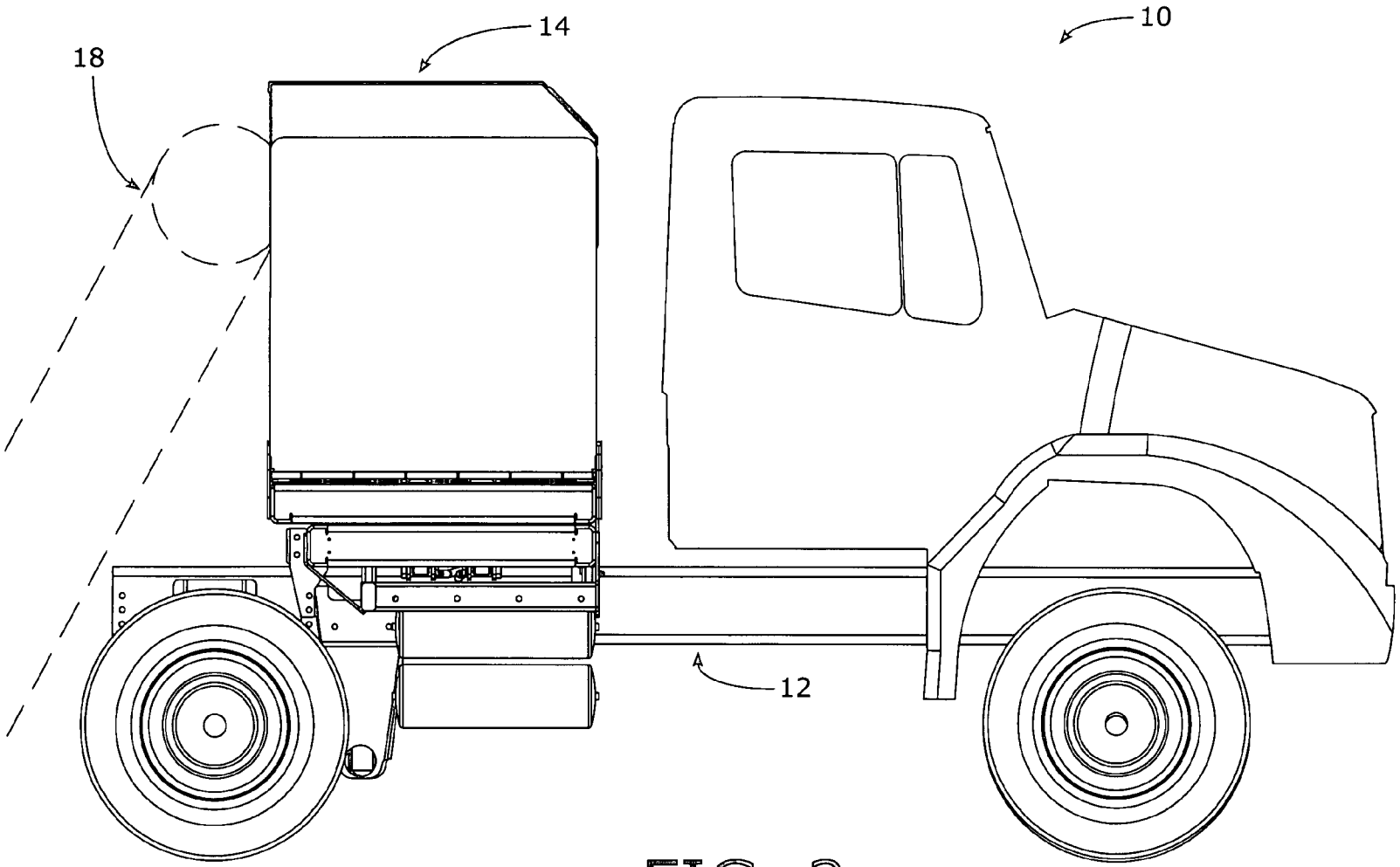
FIG. 2 is a side elevational view of the cab portion of a sweep truck body with a collection hopper and a mechanical elevator (dotted-line illustration)
Figure 3:
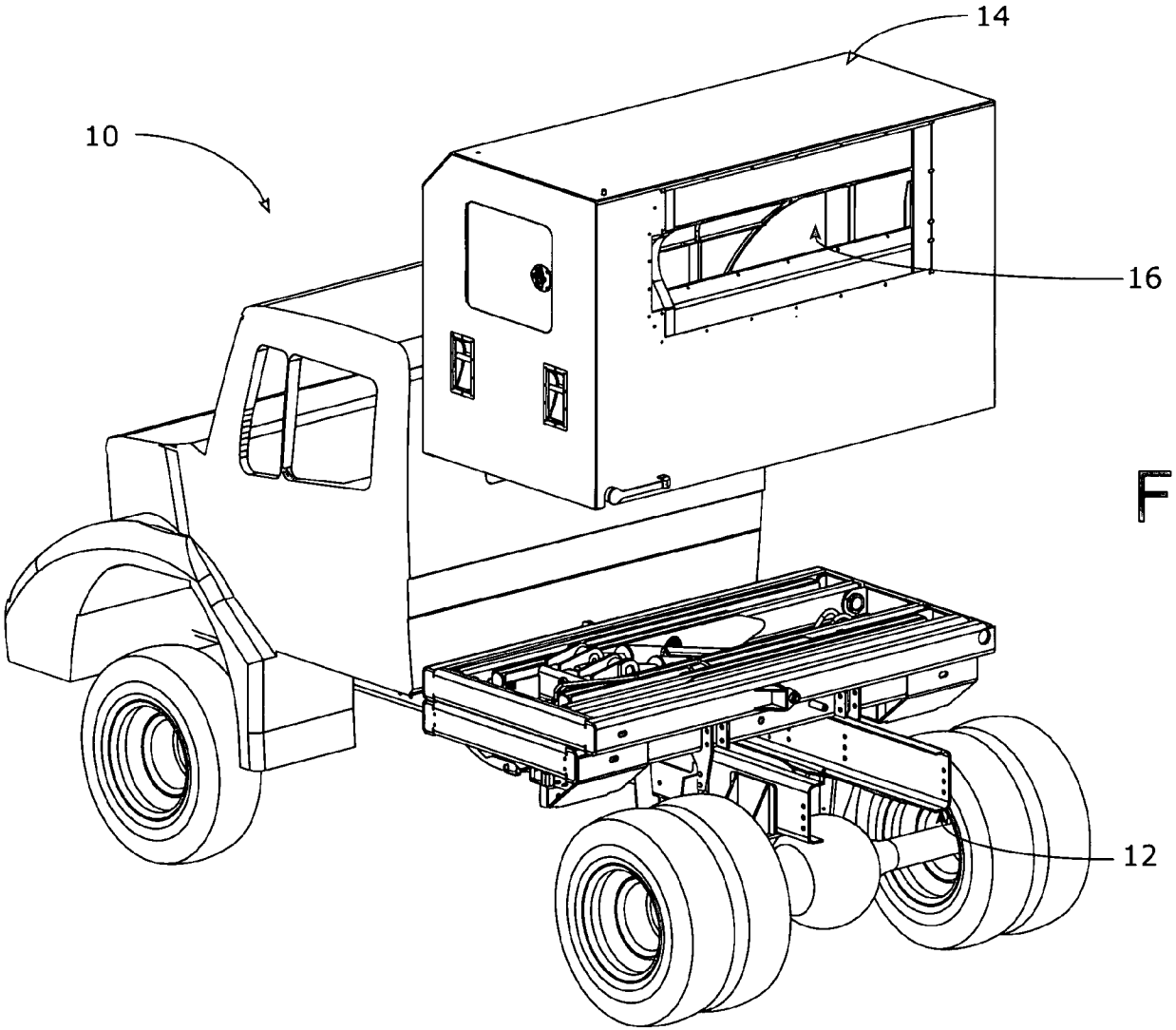
FIG. 3 is a rear perspective view of FIG. 2 with the collection hopper separated from the truck chassis for reasons of clarity.

FIG. 2 illustrates, in side view, and FIG. 3 illustrates, in rear perspective view, a portion of a mechanized broom sweeper 10 of the type sold by Schwarze Industries, Inc. of Huntsville Ala. under the M5000 or M6000 designations. As shown, the sweeper 10 includes a commercial truck chassis 12 (only part of which is illustrated) which carries a debris collection hopper 14. As best shown in FIG. 3, the collection hopper 14 includes a laterally aligned entry slot 16 through which debris is delivered by the elevator 18 (FIG. 2, dotted-line illustration).

Figure 4B:
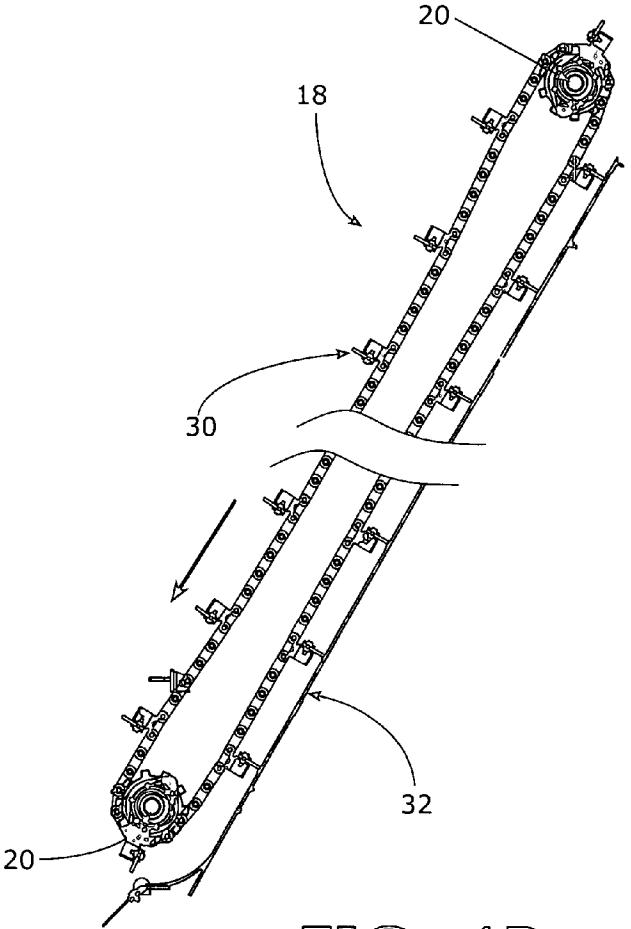
FIG. 4B is a side elevational view of the elevator of FIG. 4A.
Figure 4A:
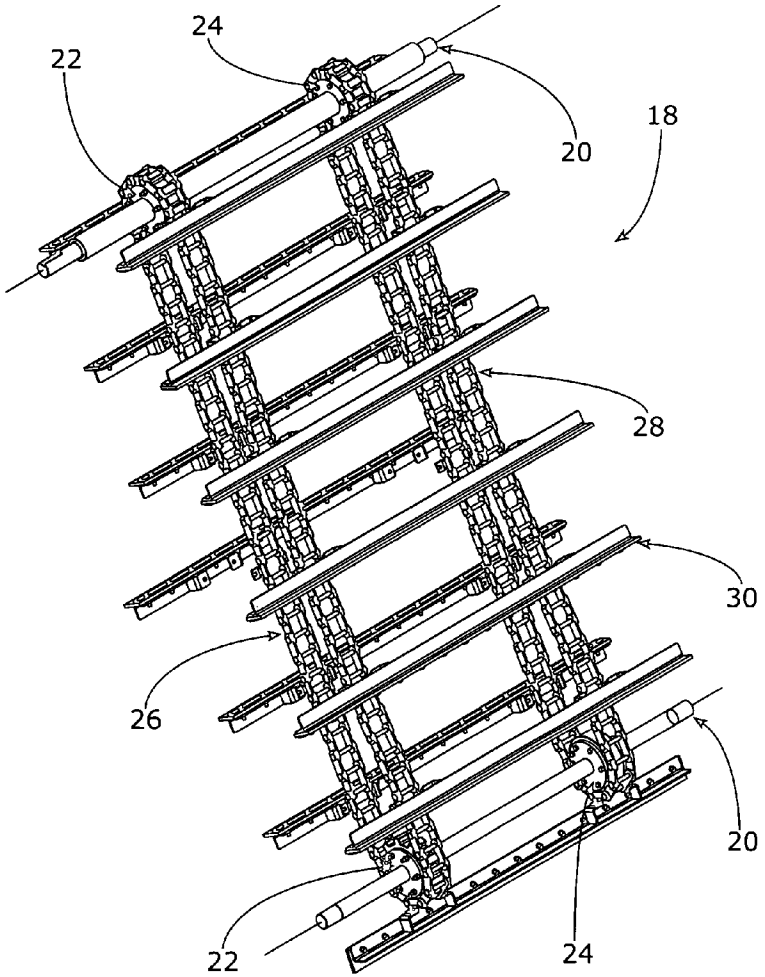
FIG. 4A illustrates a perspective view of an exemplary elevator for elevating debris to and into the collection bin.

As shown in FIGS. 4A and 4B, the elevator 18 includes a pair of spaced apart shafts 20 that each carry respective spaced apart sprockets 22 and 24. A first carrier chain 26 is entrained about the sprockets 22 of the shafts 20 and a second carrier chain 28 is entrained about the sprockets 24. Debris carrying blades or flights 30 are supported between chains 26 and 28 function to push or carry debris along a transfer plate or floor pan 32 upwardly and into the entry slot 16 of the debris collection hopper 14. The elevator 18 is typically powered by a hydraulic motor (not shown).

Figure 1:
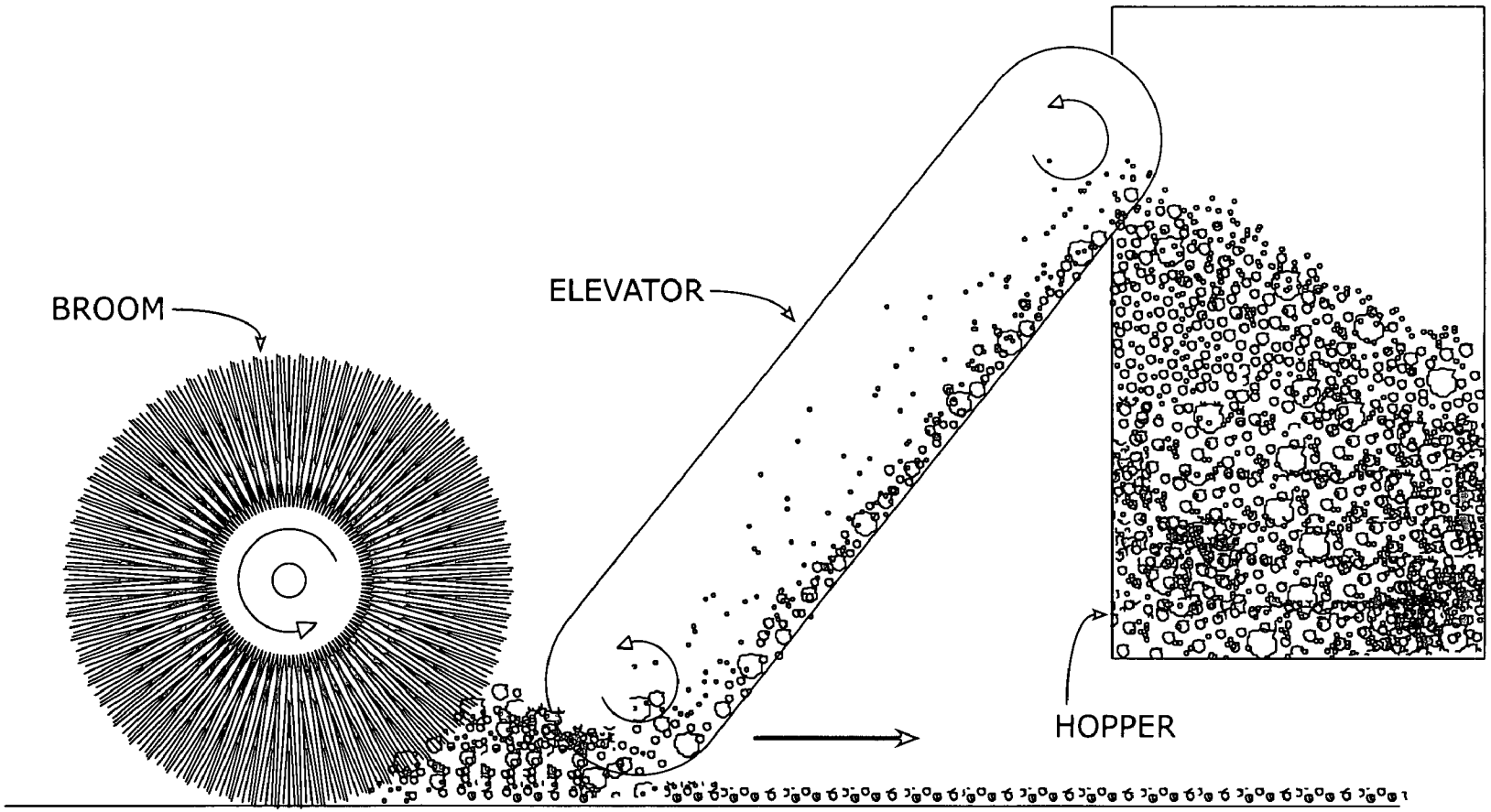
FIG. 1 is a simplified schematic view of a representative organization of the broom, elevator, and collection hopper of a broom-type mechanical sweeper.

As discussed above in relationship to FIG. 1, the debris being pushed through the entry slot 16 of the debris collection hopper 14 immediately falls therebelow to form a debris pile immediately thereunder. With time, the uppermost extent of the debris pile is located immediately below the entry inlet 16 and hinders the continued efficient operation of the elevator 18.

Figure 6:
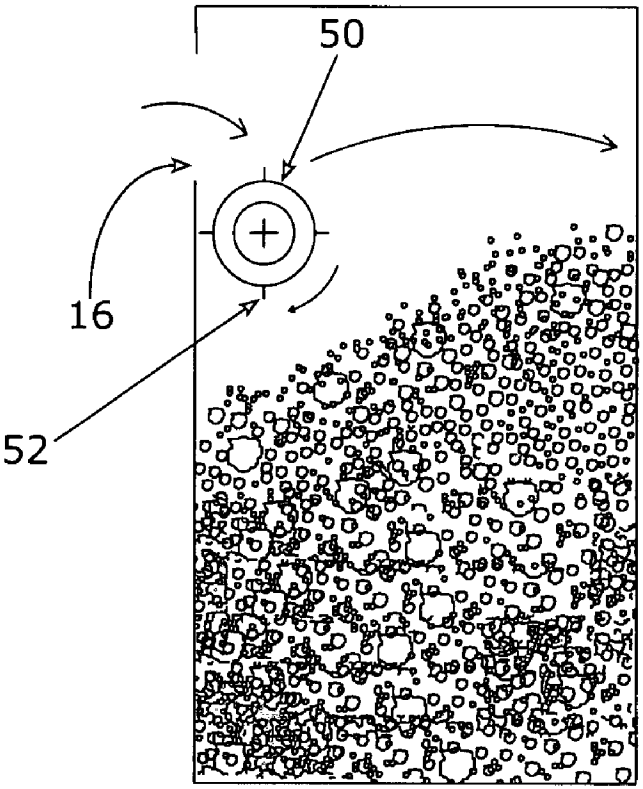
FIG. 6 illustrates, in schematic form, another form of the debris-throwing or slinging element of FIG. 5 throwing or launching debris to the forward side of the collection hopper or bin.
Figure 5:
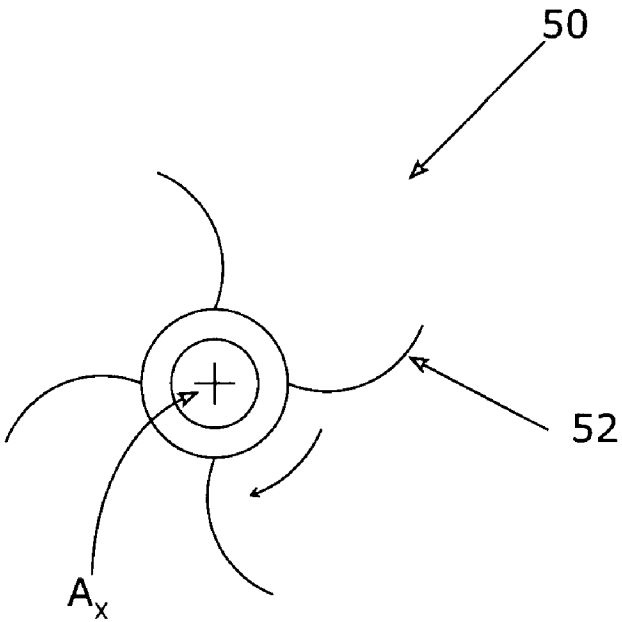
FIG. 5 illustrates, in schematic form, one form of debris-throwing or slinging element.

As shown in schematic form in FIG. 5, a "slinger' element 50 is provided to sling, throw, or fling debris from or in the general vicinity of the point or area of entry in the forward direction. The slinger element 50 is mounted for rotation in the direction shown about an axis of rotation $A_x$ and, in the schematic representation of FIG. 5, includes surface features in the form of four outwardly extending blades, paddles, or projections 52. As shown in FIG. 6, a slinger element 50 is located subjacent the entry slot 16 and has been provided with shorter arm-like 'stub' projections 52 than those shown in FIG. 5. The projections 52 shown in FIGS. 5 and 6 are illustrative only, since in practice, much shorter projections 52 are utilized. As represented in FIG. 5, the slinger element 50 is rotated as some speed, usually in the range of a few hundred rpm by a suitable motor (i.e., hydraulic). As debris is pushed through the entry slot 16 by the various flights 30 of the elevator 18, the larger pieces drop immediately toward and/or onto the slinger element 50 where one or the other of the projections 52 contacts the debris to launch or throw the so-contacted debris forwardly to the side of the debris collection hopper 14 opposite the entry slot 16. As a consequence, the debris will land upon and contribute to the formation of a debris pile on the side opposite the entry slot 16 or impact the forward wall of the debris collection hopper 14 and fall onto the debris pile. The amount of kinetic energy imparted to the debris should be at least sufficient to successfully transfer substantially all or almost all of the heaviest and largest pieces of debris away from the slinger element 50 to the side of the debris collection hopper 14 opposite thereof.

Figure 7:
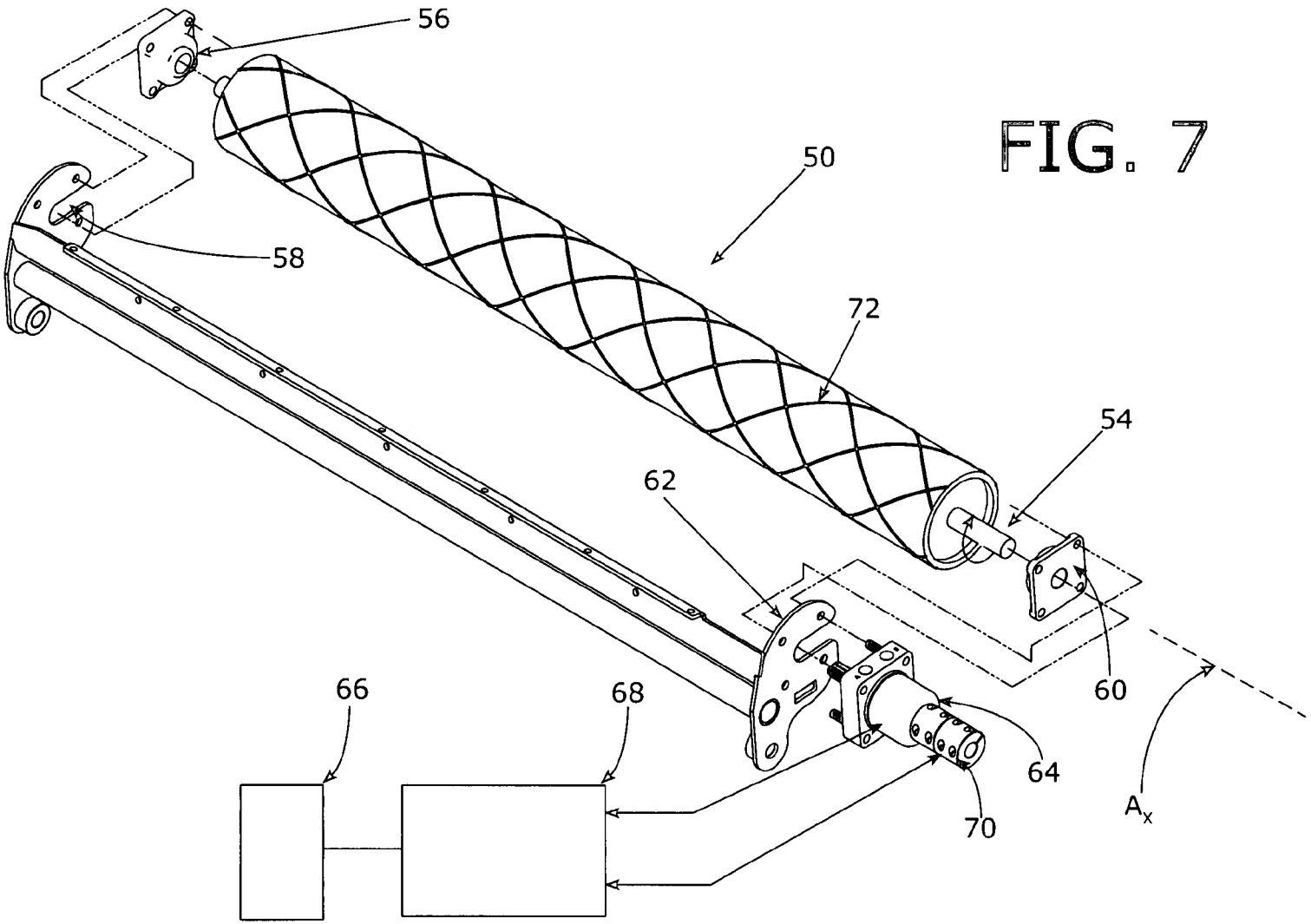
FIG. 7 illustrates an exemplary slinging roller.

FIG. 7 illustrates a preferred embodiment of a slinger element 50. As shown the slinger element 50 is formed as a cylindrical roll having a side-to-side dimension of about 60 inches (1.5 meters) sufficient to accommodate the width of the entry slot 16 and a diameter of about 6 inches, although smaller diameter (i.e., 3-4 inch) and larger diameter (i.e., 7-9 inch) rolls are suitable depending upon the application. The slinger element 50 includes a mounting shaft 54 and is carried, at its far end, in a bearing 56, that, in turn, is carried on a mounting bracket 58. In a similar manner the near-end of the slinger element 50 is journalled in another bearing 60 which, in turn, is carried on a mounting bracket 62 to support the slinger element 50.

A drive motor 64, such as a fixed-speed or variable-speed hydraulic motor, is connected to the shaft 54 to drive the slinger element 50 at a sufficient speed for the average size of the debris particles, their density, and the distance that the debris particles are thrown. In general, a rotary speed in the range of 100 to 400 rpm is considered adequate. A shown in FIG. 7, speed control can be in the form of an operator-manipulated controller 66 and a control unit 68 that controls the motor 64 in an open loop manner or which, optionally, receives feedback information from a rotational speed sensor 70 to maintain rotary speed as the quantity of debris changes. While a hydraulic drive motor is preferred, other slinger propulsion devices can be used, including pneumatic motors, electric motors, or equivalents thereof.

Figure 8:
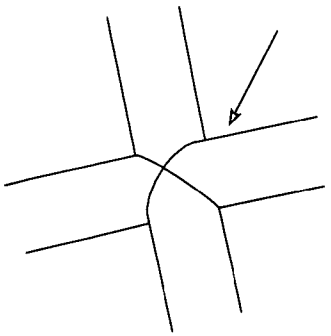
FIG. 8 is a detailed view of an exemplary surface feature of the present invention.

In contrast to the paddle like arm or projections of FIGS. 4 and 4A, the slinger element 50 of FIG. 7 has spirally aligned surface features 72 that function to engage the debris and sling, fling, or project the debris away from the entry slot 16. As shown in the detail of FIG. 8, the surface features 72 are formed by depositing at least one weld bead on the surface of the slinger element 50 that, in the case of the embodiment of FIG. 7, follows a spiral path or pattern on the surface of the roll. As shown, a plurality of such spiral-path surface features 72 can be used to create the pattern shown. The weld-bead surface feature can be formed by an automatic or pre-programmed welding machine that applies the weld bead as the roll 50 is rotated along its axis $A_x$. While the spiral-pattern of FIG. 7 is preferred, other patterns are not excluded from the present invention and can include, for example, linear weld beads formed parallel to the axis of rotation $A_x$ of the slinger element 50. In the preferred embodiment, the weld beam surface feature 72 has an elevation or height from its base to the outermost point of about 0.375 inch, although a smaller or larger-dimension weld bead is suitable depending upon the particular application.

Figure 9:
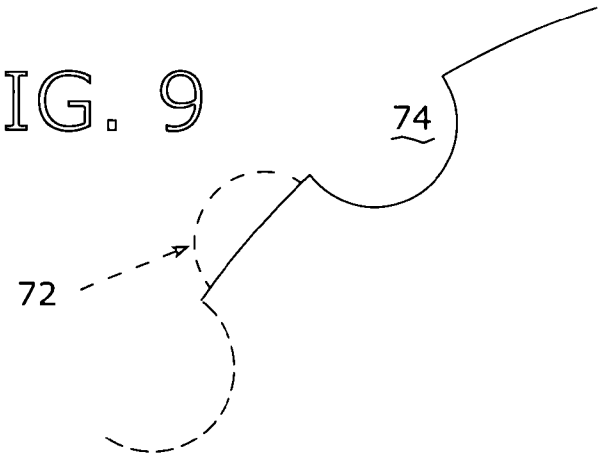
FIG. 9 is a detailed of another type of surface feature.
Figure 10:
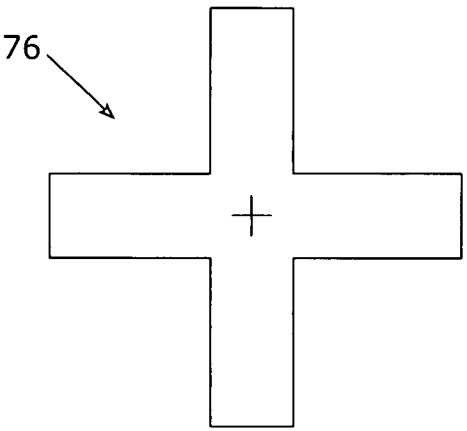
FIG. 10 is an end view of the organization of further type of slinger element.

In the embodiments of FIGS. 4, 5, and 7, the surfaces features that impart kinetic energy to the debris extend outward of the diameter surface of the slinger element 50. As can be appreciated, the notion of surface features can include features that are less than the outside diameter of the slinger element. For example and as shown in FIG. 9, a surface feature can include a groove or slot 74 that can extend laterally across the slinger element 50 or extend in the spiral pattern discussed above; if desired, the outwardly extending surface feature 72 can also be provided in combination with groove or slot 74. In addition, the slinger element 50 can take the form of a non-cylindrical structure, such as the cruciform type slinger 76 shown in FIG. 10.

Regardless of the form the slinger element takes or the nature of the surface features, during normal operation of the slinger element, debris falling from the inlet entry 16 toward or to some part of the surface of the slinger element has a high probability of receiving sufficient kinetic energy to sling, fling, throw, or launch the debris to the side of the debris collection hopper opposite from the inlet entry opening to cause the debris pile to form away from the inlet entry opening.

As will be apparent to those skilled in the art, various changes and modifications may be made to the illustrated embodiment of the present invention without departing from the spirit and scope of the invention as determined in the appended claims and their legal equivalent.

The invention claimed is:

1. A load-leveling system for broom-type mechanized sweepers of the type having a broom for collecting debris and an elevator for moving debris from the broom to an inlet opening of a debris collection container, comprising:

means located at or adjacent the inlet opening of the debris collection container for slinging, flinging, or throwing debris therefrom, the means including a surface feature for contacting debris and imparting sufficient energy thereto to sling, fling, or throw the so-contacted debris therefrom, the surface feature defined by a weld-bead formed on a surface of the first-mentioned means; and drive means connected to the first-mentioned means for driving said first-mentioned means to sling, fling, or throw debris therefrom.

2. The load-leveling system of claim 1, wherein the weld-bead follows a spiral path on the surface of the first-mentioned means.

3. The load-leveling system of claim 1, wherein the first-mentioned means includes a further surface feature for contacting debris and imparting sufficient energy thereto to sling, fling, or throw the so-contacted debris therefrom, the further surface feature defined by a groove formed on a surface of the first-mentioned means.

4. An improved debris handling system for broom-type mechanized sweepers of the type having a broom for collecting debris and an elevator for moving debris from the broom to an inlet opening of a debris collection container, the improvement comprising:

a slinger roller located at or adjacent the inlet opening of the debris collection container such that debris falls to or toward the slinger roller, the slinger roller including a surface feature for contacting debris and imparting sufficient energy thereto to sling, fling, or throw the so-contacted debris therefrom, the surface feature defined by a weld-bead formed on a surface of the slinger roller; and a drive motor for causing the slinger roller to rotate at a sufficient speed to sling, fling, or throw debris therefrom.

5. The debris handling system of claim 4, wherein the weld-bead follows a spiral path formed on the surface of the slinger roller.

6. The debris handling system of claim 4, wherein the slinger roller includes a further surface feature for contacting debris and imparting sufficient energy thereto to sling, fling, or throw the so-contacted debris therefrom, the further surface feature defined by a groove formed on the surface of the slinger roller.

* * * * *